US008944836B2

(12) United States Patent
Mori et al.

(10) Patent No.: US 8,944,836 B2
(45) Date of Patent: Feb. 3, 2015

(54) WIRE LINE CONNECTOR

(71) Applicant: Nichifu Terminal Industries Co., Ltd., Osaka (JP)

(72) Inventors: Yoshio Mori, Osaka (JP); Ryuji Kuriyama, Osaka (JP)

(73) Assignee: Nichifu Terminal Industries Co., Ltd., Osaka (JP)

( * ) Notice: Subject to any disclaimer, the term of this patent is extended or adjusted under 35 U.S.C. 154(b) by 66 days.

(21) Appl. No.: 13/754,937

(22) Filed: Jan. 31, 2013

(65) Prior Publication Data

US 2013/0210279 A1 Aug. 15, 2013

(30) Foreign Application Priority Data

Feb. 1, 2012 (JP) ..... 2012-002036

(51) Int. Cl.

| | |
|---|---|
| ***H01R 13/28*** | (2006.01) |
| ***H01R 11/11*** | (2006.01) |
| ***H01R 4/24*** | (2006.01) |
| *H01R 13/432* | (2006.01) |
| *H01R 24/84* | (2011.01) |

(52) U.S. Cl.

CPC ..... *H01R 11/11* (2013.01); *H01R 4/2454* (2013.01); *H01R 13/28* (2013.01); *H01R 13/432* (2013.01); *H01R 24/84* (2013.01)

USPC ..... 439/290

(58) Field of Classification Search

USPC ..... 439/289–291, 295, 284

See application file for complete search history.

(56) References Cited

U.S. PATENT DOCUMENTS

| | | | | | |
|---|---|---|---|---|---|
| 2,406,895 | A * | 9/1946 | Olson | 439/290 |
| 2,434,226 | A * | 1/1948 | Reynolds | 439/290 |
| 3,083,345 | A * | 3/1963 | Scheller | 439/291 |
| 3,202,954 | A * | 8/1965 | Kinkaid | 439/290 |
| 3,514,740 | A * | 5/1970 | Filson | 439/290 |
| 4,061,406 | A * | 12/1977 | Kunkle | 439/291 |
| 4,403,821 | A * | 9/1983 | Zimmerman et al. | 439/408 |
| 5,035,639 | A * | 7/1991 | Kilpatrick et al. | 439/290 |
| 5,104,332 | A * | 4/1992 | McCoy | 439/290 |
| 5,577,928 | A * | 11/1996 | Duclos | 439/290 |
| 7,153,152 | B1 * | 12/2006 | Eby et al. | 439/295 |
| 7,794,257 | B2 * | 9/2010 | Rozet et al. | 439/290 |
| 2005/0014409 | A1 * | 1/2005 | Yang et al. | 439/290 |

FOREIGN PATENT DOCUMENTS

| | | |
|---|---|---|
| JP | 3-127780 | 5/1991 |
| JP | 2005-149935 | 6/2005 |

* cited by examiner

*Primary Examiner* — Gary Paumen

(74) *Attorney, Agent, or Firm* — Antonelli, Terry, Stout & Kraus, LLP.

(57) ABSTRACT

A wire line connector includes a main contact body is provided with an electrical connection trench into which an insulated wire is compressed at the rear end, a protrusion that engages with a housing and prevents disconnection in the middle portion, and a contact portion at the front end. The portion of the contact portion on the rear end side forms parallel walls and the portion on the front end side forms protruding parallel walls in such a manner that the outer surfaces of the protruding walls and the inner surfaces of the parallel walls make contact with each other when the two connector portions are connected. The housing is provided with a step to be engaged with the protrusion for preventing disconnection of the main contact body, and an engaging hole and an engaging protrusion which prevent disconnection when the housing is connected with another housing.

2 Claims, 12 Drawing Sheets

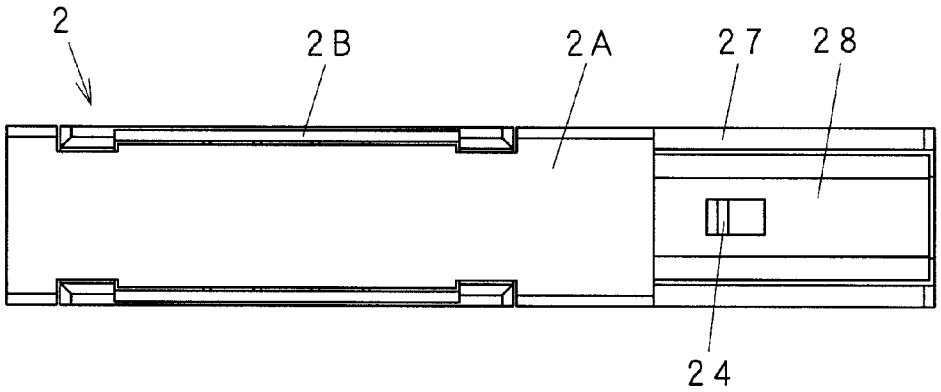
Fig. 14
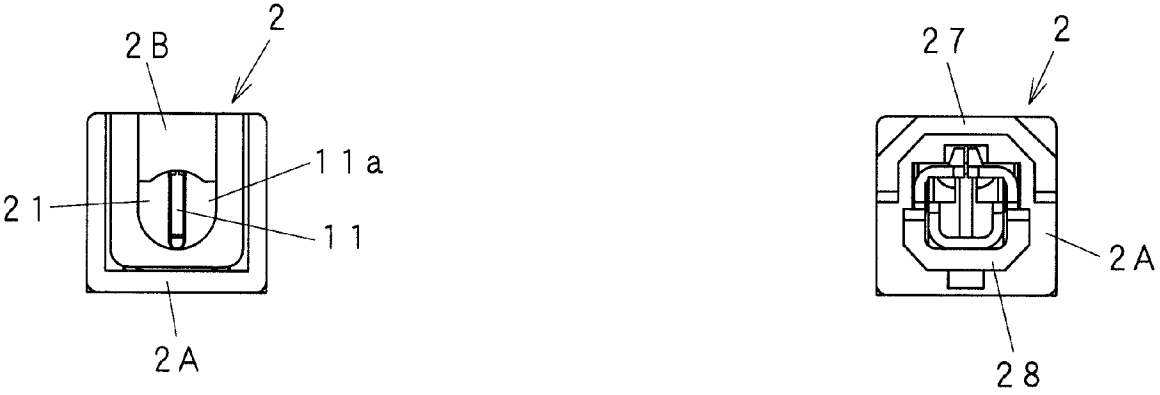
Fig. 15
Fig. 16

WIRE LINE CONNECTOR

DETAILED DESCRIPTION OF THE INVENTION

1. Technical Field

The present invention relates to a wire line connector that is used for electrical connection between two wires. In particular, the invention relates to a wire line connector having such a structure as to be appropriate for the electrical connection between wires for very low electricity, such as communication cables.

2. Background Art

Wire line connectors for electrical connection between wires have been well known, and various types of wire line connectors having various forms have already been manufactured for use. In addition, connectors used for electrical connection between wires for very low electricity, such as communication cables, have already been known.

Furthermore, connectors for the connection between wires for very low electricity, such as communication cables, and a method for making electrical connection between a cable and a connector by compressing an insulated wire into a trench with a predetermined width in the connector without stripping the insulator off the cable have been known (see Patent Document 1).

Meanwhile, connectors of which the two connector portions can be engaged and connected with the upper and lower sides and the left and right sides being at opposite positions have been publicly known (see Patent Document 2).

PRIOR ART DOCUMENTS

Patent Documents

Patent Document 1: Japanese Unexamined Patent Publication 2005-149935

Patent Document 2: Japanese Unexamined Utility Model Publication H3 (1991)-127780

SUMMARY OF THE INVENTION

Problem to be Solved by the Invention

Patent Document 1 describes a compressing type joint connector having such a structure that a number of insulated wires aligned in parallel are electrically connected to a number of compressing terminals having a trench with a predetermined width by compressing each insulated wire into the trench. However, the terminals for electrical connection are paired for engagement between male terminals for insertion and female terminals that accept the male terminals which have different shapes, and therefore, first and second housings that cover these terminals have structures with different sizes so that they are engaged with one on the outside and the other on the inside. In manufacturing these, both connectors and housings require different molds for the male and female shapes, and different assembly processes are required for the male and female shapes, and in addition, the male and female shapes must be paired when they are sold, which makes the structure inconvenient.

Patent Document 2 describes a connector where the connector has such a structure that two connector portions can be connected with the upper and lower sides and the left and right sides being at opposite positions. However, this connector has such a structure that the member for electrical connection is provided with a terminal and a blade receiving spring, where the blade receiving spring has such a structure as to be divided into upper and lower blade receiving springs with a trench in between so that a sliding blade that protrudes or recedes through the operation of a sliding button connected to a member for holding the sliding blade is held by the upper blade receiving spring so as to be slidable, while the sliding blade of another connector portion is inserted into the lower blade receiving spring so as to make electrical connection. That is to say, the upper sliding blade is the male terminal on the insertion side and the lower blade receiving spring is the female terminal for receiving the male terminal, and the sliding blade and the blade receiving spring having different shapes are electrically connected as a result of the sliding operation of the member for holding the sliding blade in the structure. In addition to the above-described member for electrical connection, the connector has such a structure that a guide member, which is provided in a portion where the engaging portion protrudes from the case and also works as a lock, engages with a protrusion provided on the sliding button so as to prevent disconnection in the structure. As a result, the number of parts is great as a whole, which makes the structure complicated and the manufacture and assembly difficult, and thus, there is a problem in that the cost is too high.

The present invention is provided in order to solve the above-described problems with the connectors according to the prior art, and thus provides a connector that has been developed on the basis of a totally new idea, where the main metal contact body for electrical connection is a single member formed of one sheet of a highly conductive metal, it is possible to connect the main contact body and an insulated wire through one action, the insulating resin housing for covering the main contact body is a simple connector cover with a single-piece body in such a form that the structure at the front end allows two housings to be engaged and connected with the upper and lower sides and the left and right sides being at opposite positions, and as a result, the two connector portions can be engaged and connected with the upper and lower sides and the left and right sides being at opposite positions, and the structure of the connector makes it possible for the two connector portions to provide a function of preventing disconnection at the same time as when they are electrically connected. The present invention provides a wire line connector having such a structure, which is simple as a whole, that can be easily manufactured and assembled and can be mass produced at low cost.

Means for Solving Problem

In order to achieve the above-described object, the present invention provides a wire line connector, comprising two connector portions having the same shape so as to be able to be electrically connected when the two connector portions are engaged with each other with the upper and lower sides and the left and right sides of one connector portion being at opposite positions relative to the other connector portion, each connector portion comprising a main contact body 1 with a single-piece structure gained by shaping a sheet of a highly conductive metal plate and an insulating resin housing 2 with a single-piece structure which covers the main contact body 1, wherein an electrical connection trench 11 into which an insulated wire is compressed is provided at the rear end of the main contact body 1; a protrusion 12 that engages with a housing 2 and prevents disconnection is provided between the front end and the rear end of the main contact body 1; and a contact portion 13 is provided at the front end of the main contact body 1, where the rear end of the contact portion 13 has parallel walls 14, 14 in U shape or square shape, and the front end of the contact portion 13 has two parallel walls 15, 15 that protrude to the front only from the side of the upper half of the parallel walls 14, 14, providing such a form that the outer surfaces of the two protruding walls 15, 15 and the inner surfaces of said parallel walls 14, 14 make contact with each other when the connector portions are connected, and the housing 2 comprises: a wire insertion hole 21 at one end; and a step 22 to be engaged with the protrusion 12 for preventing disconnection of the main contact body 1 on the inside on the front end side; and an engaging hole 23 and an engaging protrusion 24 which prevent disconnection when the housing is connected with another housing, and provides a structure such that the form of the housing 2 at the front end is symmetrical so that the two housings can be engaged with each other with the upper and lower sides and the left and right sides being at opposite positions.

In addition, the structure of the wire line connector according to claim 2 depends on that of the connector according to claim 1, and the two protruding walls 15, 15 have such a structure that small protrusions 16, 16 protrude toward the outside so as to make contact with the inner surfaces of the parallel walls 14, 14.

Effects of the Invention

The wire line connector according to the present invention has such a structure that the main contact body with a single-piece structure is formed of one sheet of a highly conductive metal plate, which is covered with an insulating resin housing having a body with a single-piece structure, and that two connector portions having the same shape can be engaged and connected through their ends with the upper and lower sides and right sides being at opposite positions. The wire line connector according to the present invention provides only one type of product that is manufactured of the respective mass-produced main contact bodies and resin housings having the same structure, and thus, only a small number of molds may be used for the formation thereof, and it is not necessary to pair male and female contact portions for sell, which omits the task of pairing. A trench for electrical connection into which an insulated wire is compressed is created in the contact bodies so that the user can easily make electrical connection between the insulated wires and the contact bodies through one action, and thus, the connector portions can be connected through one action, and as a result, a connector having such a structure that the connected state can be automatically maintained during use, thereby preventing easy disconnection, can be easily gained.

In addition, in the connector according to claim 2, the two protruding walls respectively have a small protrusion protruding toward the outside that is for the contact with the inner surface of the parallel walls, and therefore, these small protrusions can be made to make contact with the inner surface of the protruding walls of the connector, and thus, there is an advantage that electrical connection can be easily made without fail.

BRIEF DESCRIPTION OF THE DRAWINGS

FIG. 14 is a plan diagram as viewed from the bottom of the housing in FIG. 12;

FIG. 15 is a plan diagram as viewed from the left side of the housing in FIG. 12;

FIG. 16 is a plan diagram as viewed from the right side of the housing in FIG. 12;

BEST MODE FOR CARRYING OUT THE INVENTION

It is preferable for the material of the highly conductive metal plate from which main contact bodies 1 are formed according to the present invention to be a copper-based material, such as phosphor bronze, but aluminum alloy-based materials can also be used. In addition, it is preferable for the insulating resin material from which housings are formed to be polyester-based resins, such as polycarbonate, due to the excellence in the shock resistance and mechanical strength, but any resin having excellent insulation properties can be used without any particular limitations.

Preferred Embodiments

In the following, an embodiment of the present invention is described in reference to the drawings. The wire line connector according to the present invention is formed of a main contact body 1 of which the entirety is formed of one sheet of a metal plate made of phosphor bronze and a housing 2 made of polycarbonate into which the main contact body 1 is inserted so that the entirety of the main contact body 1 is covered. First, the structure of the main contact body 1 is described in reference to FIGS. 1 to 10, which show an example of the main contact body 1.

Figure 1:
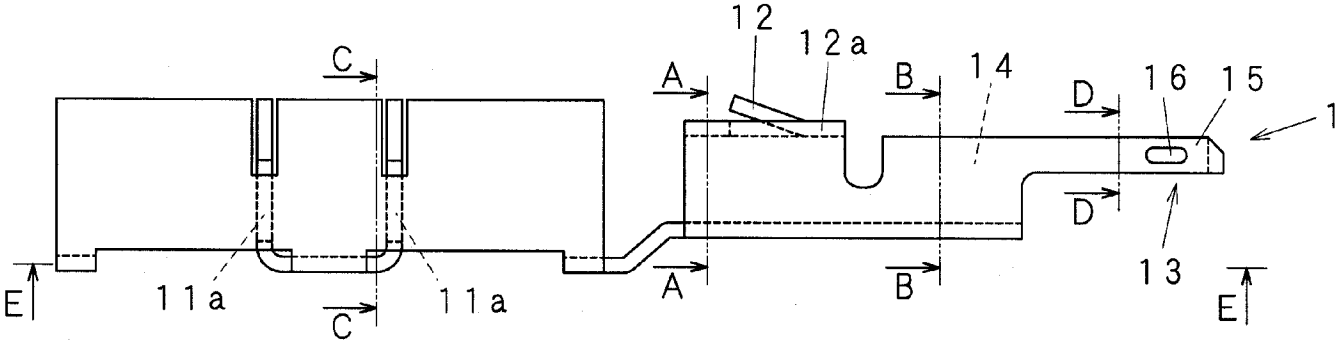
FIG. 1 is a front diagram showing a main contact body.
Figure 2:
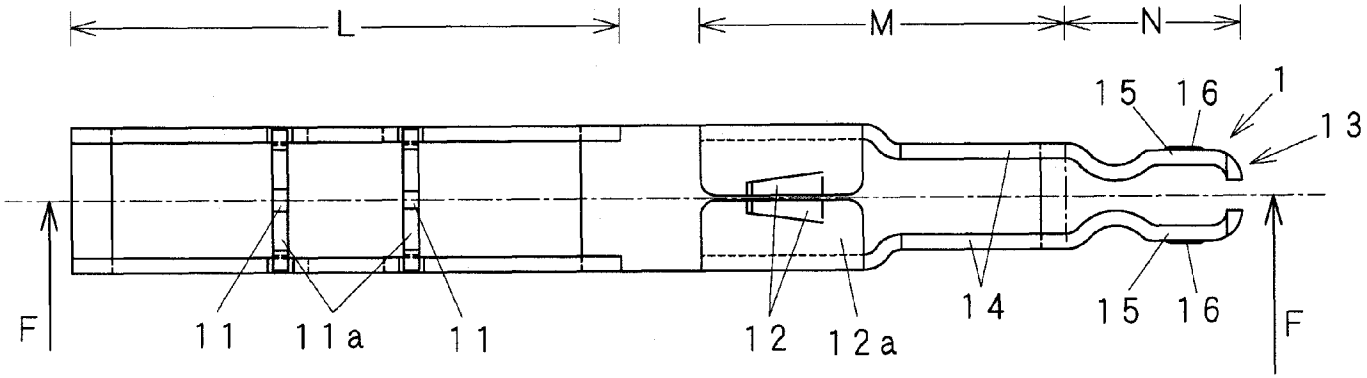
FIG. 2 is a plan diagram as viewed from the top of the main contact body in FIG. 1.
Figure 3:
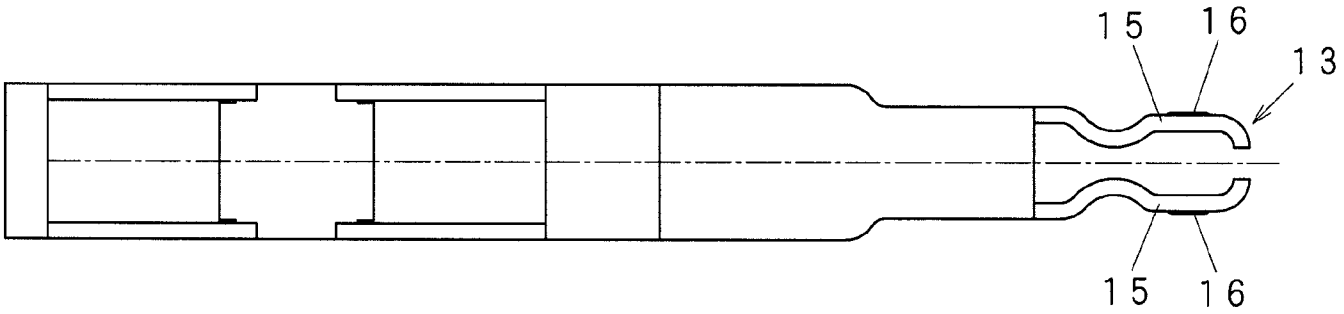
FIG. 3 is a plan diagram as viewed from the bottom of the main contact body in FIG. 1.
Figure 4:
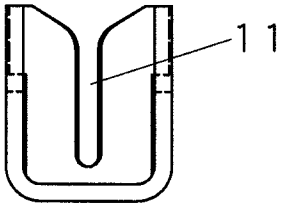
FIG. 4 is a plan diagram as viewed from the left side of the main contact body in FIG. 1.
Figure 8:
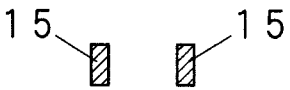
FIG. 8 is a diagram showing the end view of the sectioned part along line D-D in FIG. 1.
Figure 7:
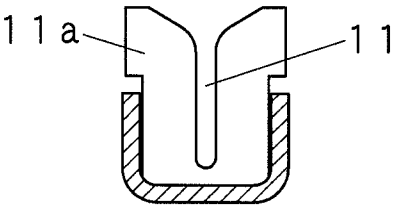
FIG. 7 is a cross-sectional diagram along line C-C in FIG. 1.
Figure 9:
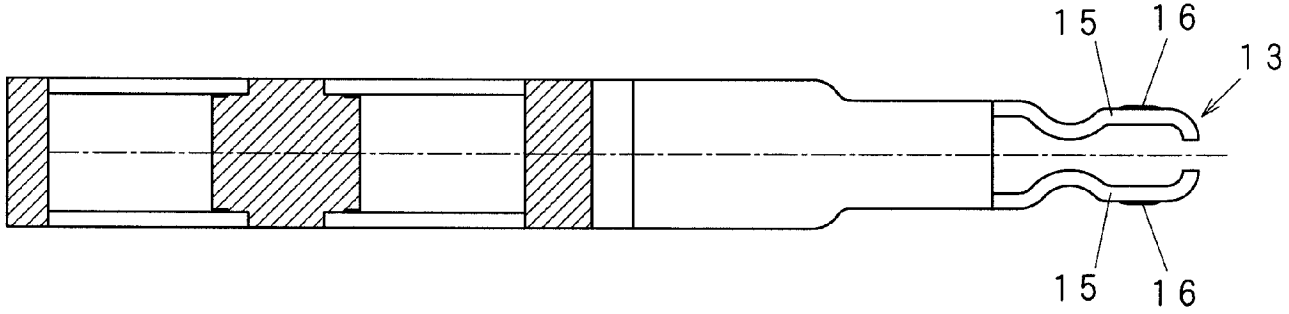
FIG. 9 is a cross-sectional diagram along line E-E in FIG. 1.
Figure 10:
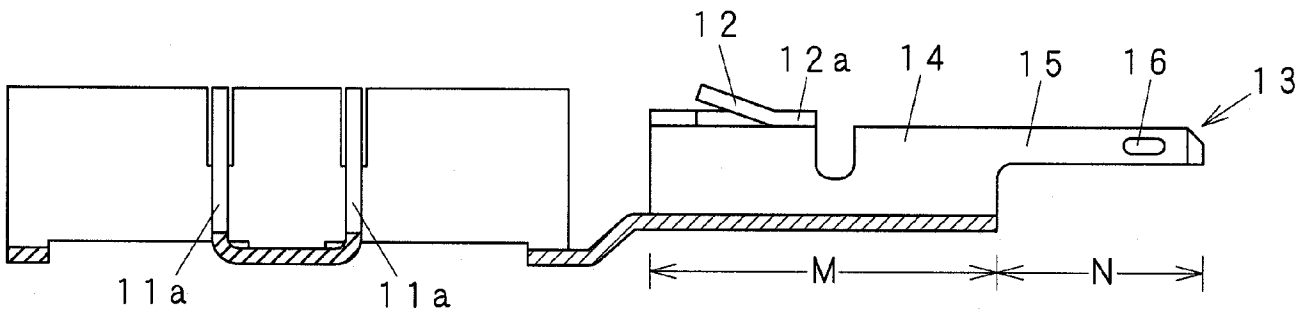
FIG. 10 is a cross-sectional diagram along line F-F in FIG. 2.

The rear end portion L of the main contact body 1 in the longitudinal direction in FIGS. 1 to 3 (left end in FIG. 2) is in U shape with an opening above as shown in FIG. 4, which shows the left side, and in FIG. 7, which is a cross-sectional diagram along C-C. When an insulated wire 3 is compressed into an electrical connection trench 11, an insulator 32 is stripped so that a wire 31 within the insulator makes electrical contact as shown below in reference to FIG. 18. The electrical connection trench 11 is created as a slit directed from top to bottom between two walls 11*a*, 11*a* for electrical connection that rises from the bottom wall as shown in FIGS. 4 and 7.

Figure 6:
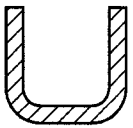
FIG. 6 is a diagram showing the end view of the sectioned part along line B-B in FIG. 1.
Figure 5:
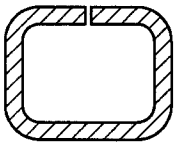
FIG. 5 is a diagram showing the end view of the sectioned part along line A-A in FIG. 1.

A middle portion M follows in the longitudinal direction, where the rear half is in a square shape in the cross-section along A-A in FIG. 5 and the front half is in U shape in the cross-section along B-B in FIG. 6 with the parallel walls 14, 14 facing each other. Furthermore, the front end portion N is formed as a contact portion 13 made of two protruding walls 15, 15 that are almost parallel with each other and protrude to the front from the upper half of the parallel walls 14, 14 as shown in FIG. 1, which is a front diagram. In addition, a protrusion 12 for preventing disconnection is formed on the upper wall 12*a* in the above-described portion in a square shape in the cross-section so as to rise facing upward and backward so that the protrusion 12 can be engaged with a step 22 in the housing 2 as described below.

Figure 11:
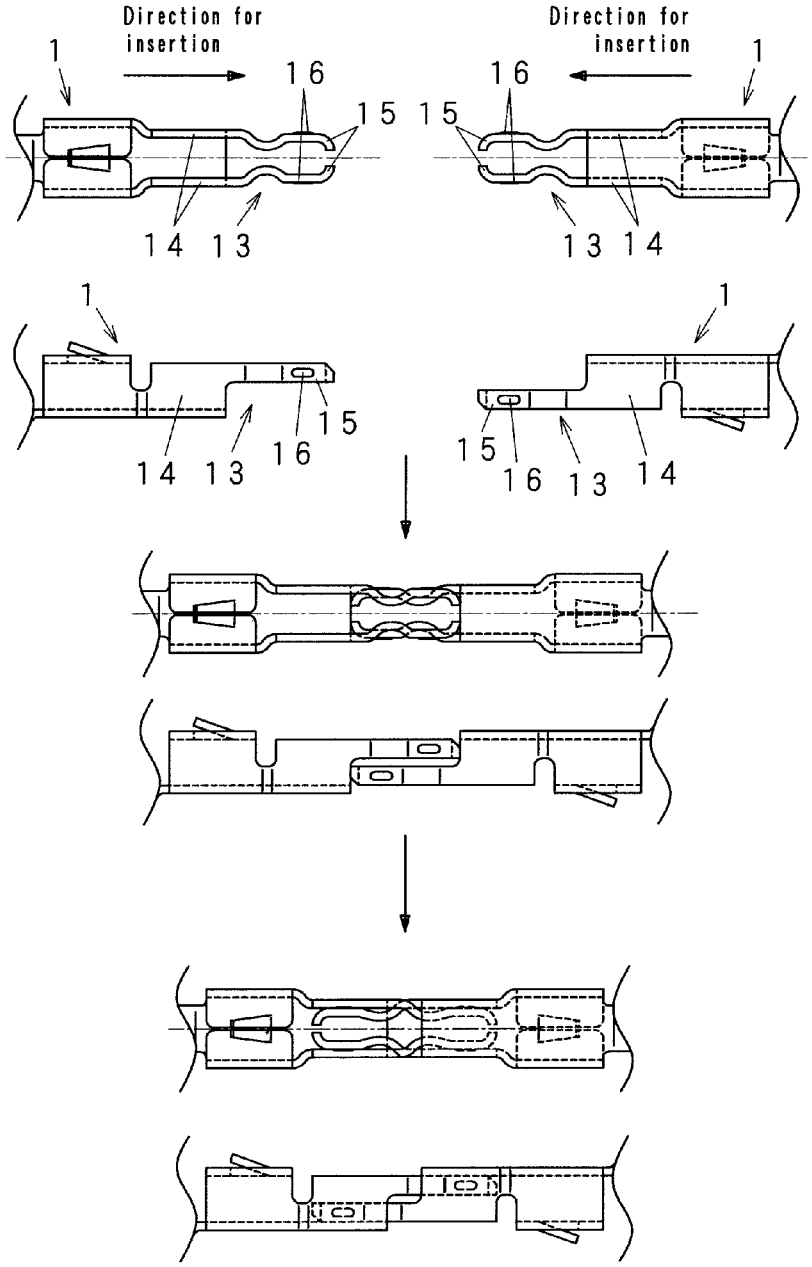
FIG. 11 is a diagram for illustrating the state where main contact bodies are connected to each other.

In addition, the above-described two protruding walls 15, 15 have such a distance in between that the outer surfaces of these two protruding walls 15, 15 make electrical contact with the inner surfaces of the above-described parallel walls 14, 14 due to the elastic properties of these when connector portions are made to make contact with each other as illustrated in FIG. 11 in the following. In order to secure this electrical contact without fail, small protrusions 16, 16 are formed on the protruding walls 15, 15 so as to respectively protrude toward the outside so that the small protrusions 16, 16 make contact with the inner surfaces of the parallel walls 14, 14 through surfaces in the connector according to the present embodiment.

Figure 17:
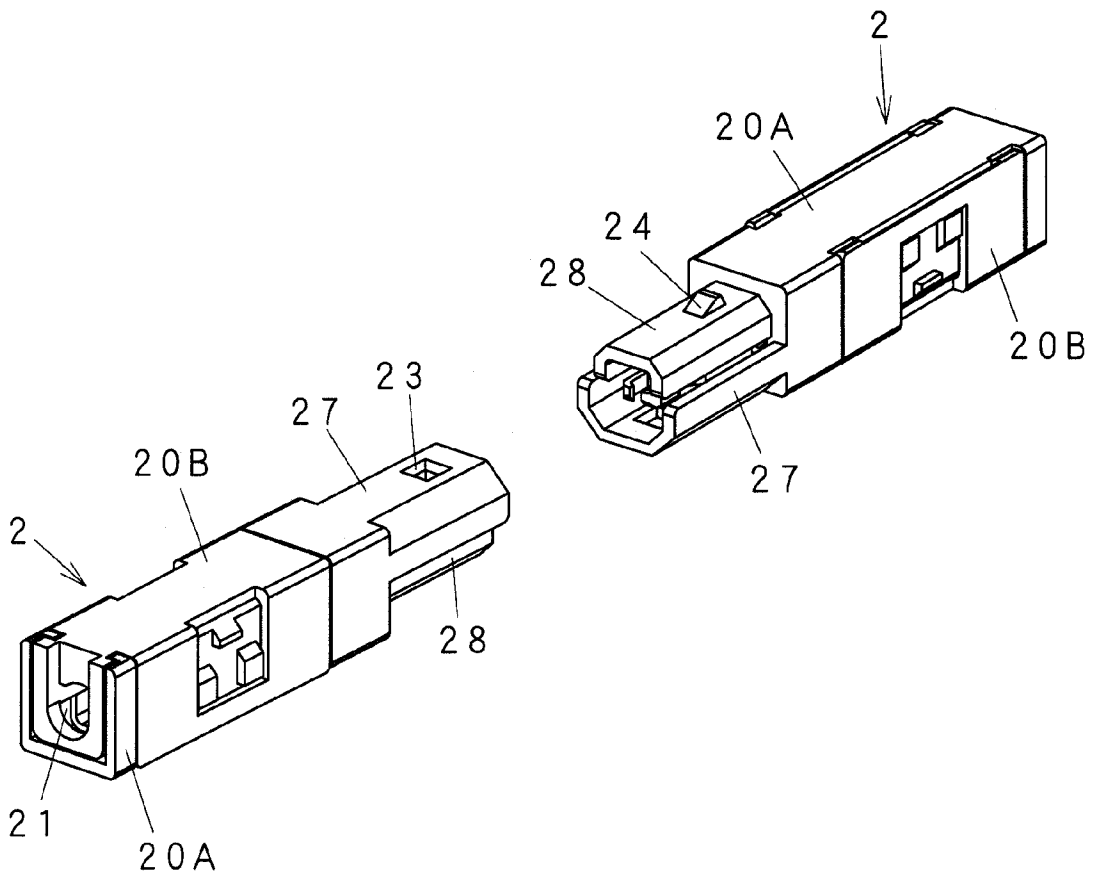
FIG. 17 is a perspective diagram showing two connector bodies that have been placed so as to face each other.

The main contact bodies 1 having the above-described structure are made to make electrical contact with each other when the two housings 2, 2 having the same structure are inserted into and engaged with each other with the upper and lower sides and the left and right sides being at opposite positions as shown in FIG. 17, which is a perspective diagram where the main contact bodies are respectively inserted into the housings 2.

FIG. 11 shows the main contact bodies 1 chronologically when they are connected to each other in three steps: first, second and third, which are respectively shown in the top, middle and bottom parts of the diagram, each step being shown in a plan diagram on the upper side and in a front diagram on the bottom side. First, as shown in the illustration for the first step, two main contact bodies 1, 1 are moved from the position where they are at a distance away from each other in the direction in which they are inserted into each other. Next, as shown in the illustration for the second step, the contact portions 13 at the respective ends are positioned either on the upper side or the lower side as viewed in the front diagram, and this position is maintained when they are moved to the locations at the ends of the parallel walls 14, 14 having a cross-section in U shape. The main contact bodies 1 are further moved, as shown in the illustration for the third step, until the contact portions 13 at the ends enter into the spaces between the parallel walls 14, 14 of the opposing main contact bodies 1. The surfaces of these two portions that face each other, that is to say, the outer surfaces of the protruding walls 15, 15 that form the contact portions 13 and the inner surfaces of the parallel walls 14, 14 make elastic contact with each other so as to provide an electrically connected state. Small protrusions 16, 16 are respectively formed on the protruding walls 15, 15 that form the contact portions 13 in this embodiment so as to protrude toward the outside, and therefore, these small protrusions 16, 16 make contact with the inner surfaces of the parallel walls 14, 14 through surfaces when the electrically connected state is provided.

Next, the housing 2 for containing the main contact body 1 having the above-described structure in such a state as being electrically insulated is described. Though the material from which this housing 2 is made is not particularly limited as long as it is a resin material having insulating properties, the housing 2 according to the present embodiment is formed of a polycarbonate resin material.

Figure 12:
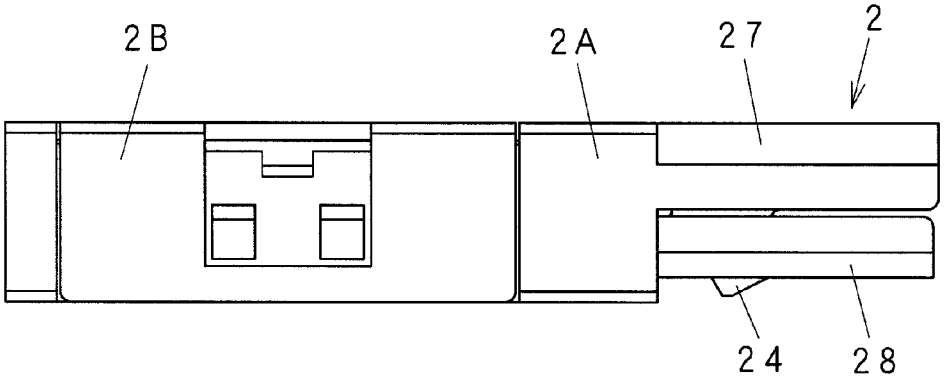
FIG. 12 is a front diagram showing the appearance of a housing.
Figure 13:
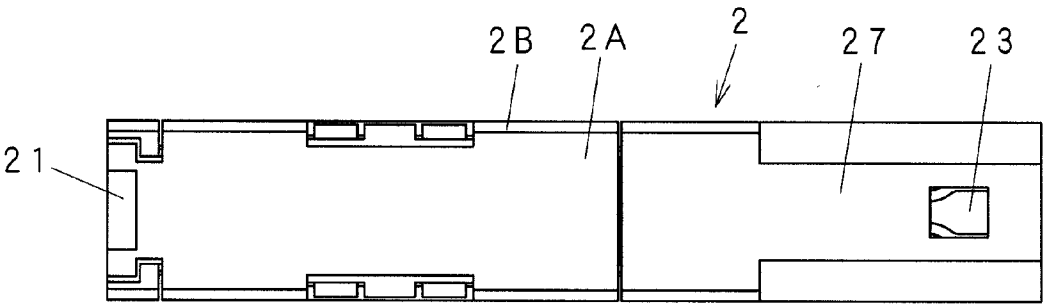
FIG. 13 is a plan diagram as viewed from the top of the housing in FIG. 12.
Figure 18:
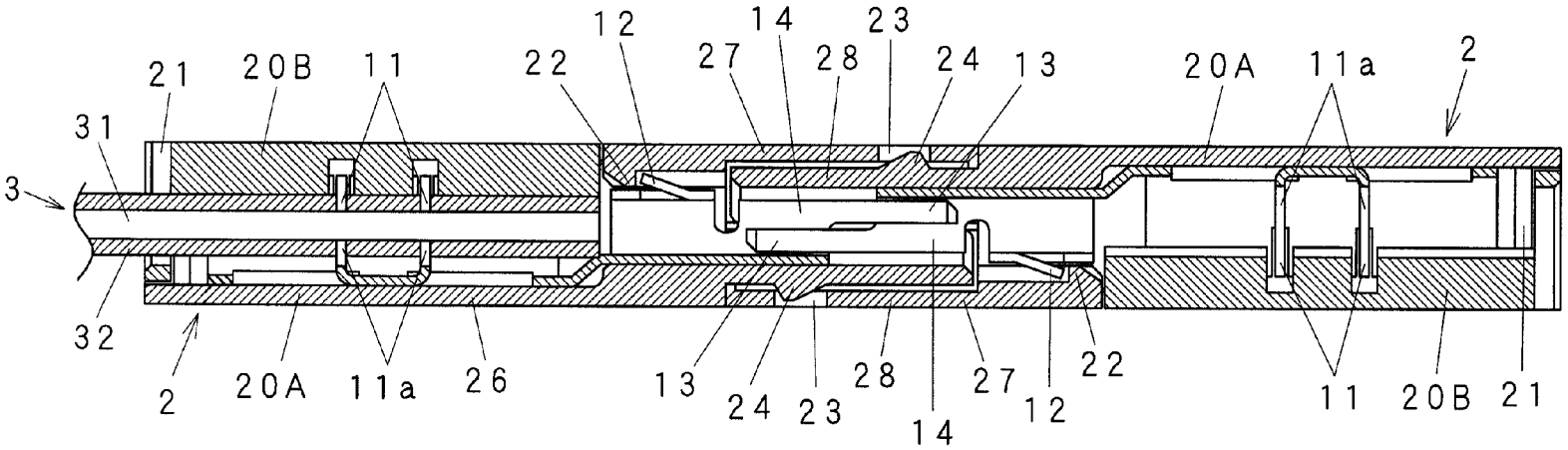
FIG. 18 is a cross-sectional diagram along the center line as viewed from the front for illustrating the state where two connector bodies are connected.

As the appearance of the housing 2 is shown in FIGS. 12 to 18, the housing 2 is made up of a main housing body 20A and a lid 20B, where the left half of the structure in the front diagram of FIG. 12 is approximately in U shape in which the rear end portion L of the above-described main contact body 1 in the longitudinal direction is contained, and the upper portion thereof is covered by the lid 20B. This lid 20B is attached to the main housing body 20A by being pressed from the top after an insulated wire 3 has been placed on electrical connection walls 11*a*, 11*a* in the above-described main contact body 1, and thus, the insulated wire 3 is simultaneously pushed into electrical connection trenches 11 so that the insulated wire 3 makes electrical connection with the electrical connection walls 11*a*, 11*a* when being compressed as shown in FIG. 18. At this time, the parallel walls 14 in the middle portion M of the main contact body 1 in the longitudinal direction and the contact portions 13 in the front end portion N are also respectively placed within the main housing body 20A as shown in FIG. 18.

As shown in the plan view as viewed from the right side of FIG. 16 and in the perspective diagram of FIG. 17 showing the appearance of two connector bodies placed so as to face each other, a predetermined length of the main contact body 1 in the housing 2 ranging to cover the middle portion M and the front end portion N in the longitudinal direction is divided into two parts, top and bottom, which are a large eaves portion 27 and a small insertion portion 28 that can engage with each other. A hole 23 is provided in the large eaves portion 27 and a protrusion 24 is formed on the corresponding portion of the small insertion portion 28 so that the hole and the protrusion engage with each other so as to function as a prevention of disconnection when two connector bodies are connected.

In other words, as shown in the cross-sectional diagram of FIG. 18 along the center line of two connector bodies for illustrating the state where the two connector bodies are connected to each other, the housing 2 has a hole 21 through which a wire is to be inserted at one end. A step 22 with which a protrusion 12 for preventing disconnection in the main contact body 1 is to be engaged is provided at the base of the large eaves portion 27. In addition, the hole 23 and the protrusion 24 that engage with each other in order to function as a prevention of disconnection when two housings 2, 2 are connected to each other are created in the structure.

Though the figures show enlargements of the structure in order to make it easy to understand, the actual size of the connector in the present embodiment is described as follows for reference. The length between the left and right of the main contact body 1 in FIG. 1 is 23 mm to 25 mm, and the length between the left and right of the housing 2 in FIG. 12 is approximately 25 mm to 27 mm. The size differs depending on the diameter of the insulated wires to be connected and the level of the electrical power to be connected.

Though typical embodiments of the present invention are described in the above, modifications are possible for the present invention as long as the above-described constituent features are satisfactory for the present invention, the above-described object is achieved, and the above-described effects are gained.

INDUSTRIAL APPLICABILITY

The connector according to the present invention makes it possible for the connector and the insulated wires to be electrically connected through one action, and in addition, for the connection portions to be connected in an extremely simple action, and therefore, there is a large potential for it to be widely used in the market.

EXPLANATION OF SYMBOLS

1 main contact body
2 housing
11 electrical connection trench
12 protrusion for preventing disconnection
13 contact portion
14 parallel wall
15 protruding wall
16 small protrusion
21 hole through which a wire is to be inserted
22 step to be engaged with a protrusion
23 hole to be engaged with a protrusion
24 protrusion to be engaged with a hole

The invention claimed is:

1. A wire line connector, comprising two connector portions having the same shape so as to be able to be electrically connected when the two connector portions are engaged with each other with an upper and lower sides and a left and right sides of one connector portion being at opposite positions relative to the other connector portion, each connector portion comprising a main contact body (1) with a single-piece structure gained by shaping a sheet of a highly conductive metal plate and an insulating resin housing (2) with a single-piece structure which covers the main contact body (1), wherein an electrical connection trench (11) into which an insulated wire is compressed is provided at a rear end of the main contact body (1); a protrusion (12) that engages with a housing (2) and prevents disconnection is provided between a front end and the rear end of the main contact body (1); and a contact portion (13) is provided at the front end of the main contact body (1), where the rear end of the contact portion (13) has parallel walls (14, 14) in U shape or square shape, and the front end of the contact portion (13) has two parallel walls (15, 15) that protrude to the front only from the side of the upper half of the parallel walls (14, 14), providing such a form that the outer surfaces of the two protruding walls (15, 15) and the inner surfaces of said parallel walls (14, 14) make contact with each other when the connector portions are connected, and the housing (2) comprises: a wire insertion hole (21) at one end; and a step (22) to be engaged with the protrusion (12) for preventing disconnection of the main contact body (1) on the inside on the front end side; and an engaging hole (23) and an engaging protrusion (24) which prevent disconnection when the housing is connected with another housing, and provides a structure such that the form of the housing (2) at the front end is symmetrical so that the two housings can be engaged with each other with the upper and lower sides and the left and right sides being at opposite positions.

2. The wire line connector according to claim 1, wherein the two protruding walls (15, 15) have such a structure that small protrusions (16, 16) protrude toward the outside so as to make contact with the inner surfaces of the parallel walls (14, 14).

* * * * *